US006359541B1

(12) United States Patent
Watanabe

(10) Patent No.: US 6,359,541 B1
(45) **Date of Patent: *Mar. 19, 2002**

(54) SURFACE-MOUNTED ELECTROMAGNETIC SOUND GENERATOR

(75) Inventor: Keita Watanabe, Fujiyoshida (JP)

(73) Assignee: Citizen Electronics Co., Ltd., Yamanashi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/439,761

(22) Filed: Nov. 15, 1999

(30) Foreign Application Priority Data

Nov. 29, 1998 (JP) ..... 10-353836

(51) Int. Cl.[7] ..... H01F 7/00

(52) U.S. Cl. ..... 335/301; 336/83; 336/200; 336/232

(58) Field of Search ..... 335/301; 336/200, 336/223, 232, 83

(56) References Cited

FOREIGN PATENT DOCUMENTS

| | | | |
|---|---|---|---|
| JP | 64-33914 | * | 2/1989 |
| JP | 1-196109 | * | 8/1989 |
| JP | 7-161535 | * | 6/1995 |
| JP | 11-16747 | * | 1/1999 |

* cited by examiner

*Primary Examiner*—Lincoln Donovan
*Assistant Examiner*—Tuyen T. Nguyen
(74) *Attorney, Agent, or Firm*—Koda & Androlia

(57) ABSTRACT

A surface-mounted electromagnetic sound generator includes a yoke accommodated inside a case, a coil attached to the yoke, a ring-shaped magnet placed about the coil, a vibration plate disposed to oppose the yoke and a plurality of surface-mounted electrodes. The underside of the magnet is provided with a plurality of recesses at symmetrical positions thereof, each recess extending through the magnet in tunnel-like fashion from the inner circumferential surface to the outer circumferential surface of the magnet. Terminals of the coil are connected to respective ones of the electrodes in respective ones of the recesses of the magnet. Thus the connections fall within the space occupied by the magnet.

6 Claims, 4 Drawing Sheets

SURFACE-MOUNTED ELECTROMAGNETIC SOUND GENERATOR

BACKGROUND OF THE INVENTION

1. Field of the Invention

This invention relates to an electromagnetic sound generator in which sound is generated by vibrating a vibration plate using an electromagnet. More particularly, the invention relates to an electromagnetic sound generator having such a structure that surface-mounted electrodes and coil connections are disposed in an area in which the magnet is placed.

2. Description of the Related Art

Surface-mounted electromagnetic sound generators of this type in accordance with the prior art have structures of the kind shown in FIGS. 5 to 8. Specifically, the surface-mounted electromagnetic sound generator illustrated in FIGS. 5 and 6 includes a ring-shaped magnet 6 disposed about the periphery of a coil 4 attached to a central yoke 2, and a vibration-plate supporting frame 10, which supports a vibration plate 8, disposed about the periphery of the magnet 6. To connect terminals 4*a*, 4*b* of the coil 4, the terminals 4*a*, 4*b* are passed beneath the magnet 6 and vibration-plate supporting frame 10, led out to the exterior of the magnet 6 and vibration-plate supporting frame 10 and soldered to connecting portions 12*a*, 14*a* of electrodes 12, 14, respectively.

To connect coil terminals in the conventional surface-mounted electromagnetic sound generator depicted in FIGS. 7 and 8, use is made of a planar, generally C-shaped magnet 16 a part which has a cut-out 16*a*, the connecting portions 12*a*, 14*a* of the respective electrodes 12, 14 are led into the cut-out 16*a* of the magnet 16 and the terminals 4*a*, 4*b* of the coil 4 are soldered to the connecting portions 12*a*, 14*a*, respectively.

In the conventional surface-mounted electromagnetic sound generator shown in FIGS. 5 and 6, the terminals 4*a*, 4*b* of the coil 4 and the connecting portions 12*a*, 14*a* of the respective electrodes 12, 14 are connected in a space located outside the magnet 6. This is disadvantageous in that the size of a case 18 must be increased by an amount commensurate with the connection space, thus making it difficult to achieve a more compact design.

In the conventional surface-mounted electromagnetic sound generator shown in FIGS. 7 and 8, the terminals 4*a*, 4*b* of the coil 4 and the connecting portions 12*a*, 14*a* of the respective electrodes 12, 14 are connected in the cut-out 16*a* of the magnet 16. This makes it possible to achieve a size that is smaller in comparison with the structure shown in FIG. 5. However, since use is made of the generally C-shaped magnet 16, the cut-out 16*a* causes a slight imbalance in the characteristics of the magnetic circuit as compared with the ring-shaped magnet. Though this is so small as to have absolutely no effect upon such factors as the frequency characteristic and sound-pressure level, which are important characteristics of an electromagnetic sound generator, it does cause the vibration plate 8 to vibrate abnormally, as by causing the vibration plate to vibrate non-uniformly. This can result in metallic sounds caused by sound break-up. In particular, since it is required that the two terminals of the coil be soldered to two connecting portions of electrodes inside the cut-out 16*a*, this necessitates enough space to receive the two connection locations and to allow the soldering work. It is difficult, therefore, to reduce the size of the cut-out 16*a* and, as a consequence, to improve balance of the characteristics of the magnetic circuit.

SUMMARY OF THE INVENTION

Accordingly, an object of the present invention is to provide a surface-mounted electromagnetic sound generator in which space for connections between coil terminals and surface-mounted electrode is provided without enlarging the size of the device, and in which performance can be enhanced by eliminating abnormal vibration of the vibration plate.

According to the present invention, the foregoing object is attained by providing a surface-mounted electromagnetic sound generator comprising: a case; a yoke accommodated inside the case; a coil attached to the yoke; a ring-shaped magnet placed about the coil and having an inner circumferential surface, an outer circumferential surface and an underside provided with a plurality of recesses at symmetrical positions thereof, each recess extending through the magnet in tunnel-like fashion from the inner circumferential surface to the outer circumferential surface; a vibration plate disposed to oppose the yoke; and a plurality of surface-mounted electrodes each having a joining portion led out to the exterior of the case for being joined to an external electrically. conductive member, and a connecting portion led into one of the recesses of the magnet; wherein the terminals of the coil are pulled into-the plurality of recesses of the magnet and attached to respective ones of the connecting portions of the electrodes.

According to another aspect of the present invention, the foregoing object is attained by providing a surface-mounted electromagnetic sound generator comprising: a case; a yoke accommodated inside the case; a coil attached to the yoke; a ring-shaped magnet placed about the coil and having an inner circumferential surface, an outer circumferential surface and an underside provided with a plurality of recesses at symmetrical positions thereof, each recess extending into the magnet in tunnel-like fashion from the inner circumferential surface without opening to the outer circumferential surface; a vibration plate disposed to oppose the yoke; and a plurality of surface-mounted electrodes each having a joining portion led out to the exterior of the case for being joined to an external electrically conductive member, and a connecting portion led into one of the recesses of the magnet; wherein the terminals of the coil are pulled into the plurality of recesses of the magnet and attached to respective ones of the connecting portions of the electrodes.

The connecting portions of the plurality of electrodes in the surface-mounted electromagnetic sound generator are either led into respective ones of different recesses of the plurality thereof or into one recess of the plurality thereof.

Thus, in the surface-mounted electromagnetic sound generator according to embodiment of the present invention, the terminals of the coil are connected to the connecting portions of the electrodes in the plurality of recesses provided in the ring-shaped magnet at symmetrical positions. Specifically, the recesses of the magnet are positioned so as to be mutually symmetrical and are formed as openings in the underside of the magnet so as to pass through the magnet from its inner to its outer circumferential surfaces in tunnel-like fashion. The coil is situated inside the magnet and its terminals are pulled into the recesses from the openings on the inner circumferential side and are connected to the respective connecting portions of the electrodes within the recesses. The connections between the coil terminals and the electrode connecting portions, therefore, fall within the space where the magnet is disposed. As a result, the space where the connections are located need not be provided on the outer side of the magnet or vibration-plate supporting frame. This makes it possible to obtain an extremely thin and small-size sound generator.

Further, providing the plurality of recesses at symmetrical positions eliminates local variations in the strength of magnetic lines of force that act upon the vibration plate, thereby providing greater uniformity in the lines of force. This makes it possible to prevent the occurrence of abnormal vibrations in the vibration plate and to improve performance.

Further, the connecting portions of the plurality of electrodes are led into different recesses, with one connecting portion being led into one recess. The terminals of the coil are connected to respective ones of the connecting portions thus led into different respective ones of the recesses. This means that the size of the opening to each recess need only be large enough to accommodate one terminal of the coil and one connecting portion of an electrode. Accordingly, the width of the, opening of each recess can be very small and the balance of the characteristics of the magnetic circuit can be improved.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A preferred embodiment of the present invention will now be described in detail with reference to the accompanying drawings.

Figure 1:
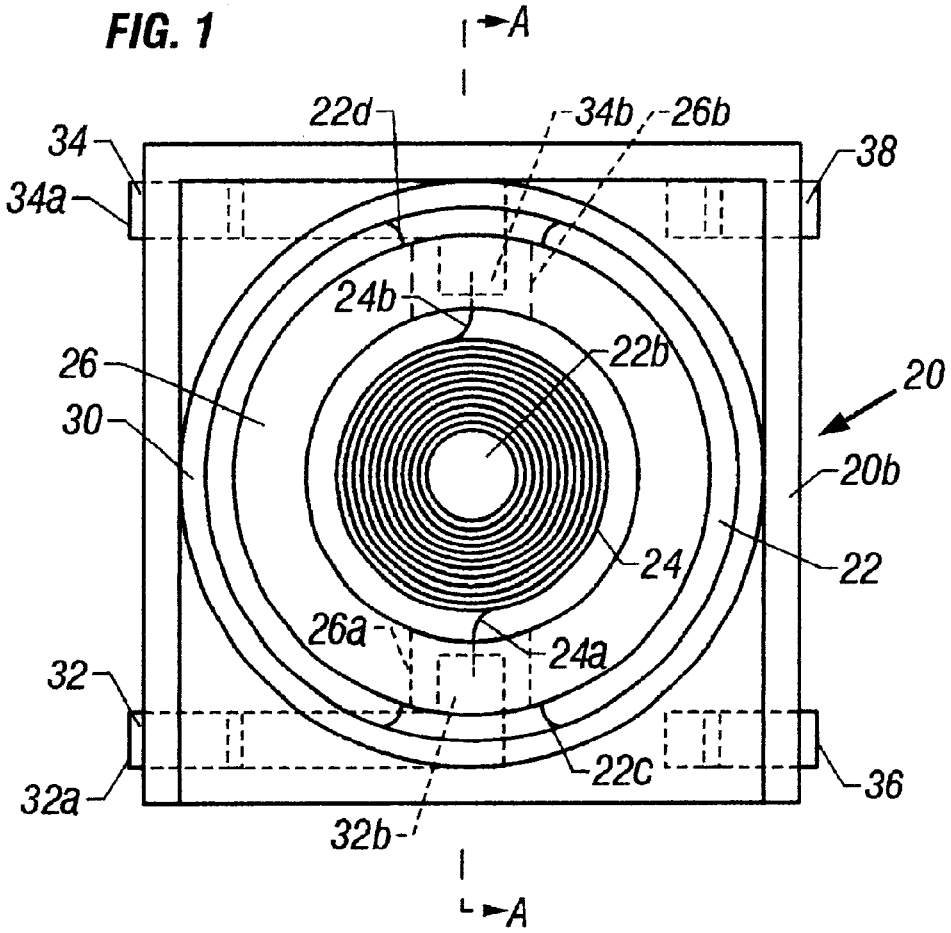
FIG. 1 is a plan view illustrating the structure of a surface-mounted electromagnetic sound generator according to an embodiment of the present invention, this view showing the structure after an upper case and vibration plate have been removed.
Figure 2:
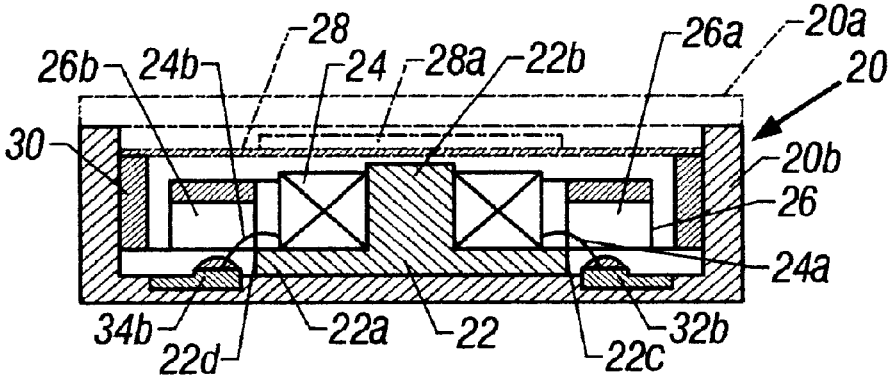
FIG. 2 is a sectional view taken along line A—A of the surface-mounted electromagnetic sound generator shown in FIG. 1.

FIG. 1 is a plan view illustrating the structure of a surface-mounted electromagnetic sound generator according to this embodiment of the present invention, this view showing the structure after an upper case and vibration plate have been removed, and FIG. 2 is a sectional view taken along line A—A of FIG. 1.

The surface-mounted electromagnetic sound generator has a case 20 made of plastic. In this embodiment the case 20 has a box-like external configuration the planar shape of which is rectangular and is constituted by an upper case 20*a* and a lower case 20*b*.

A yoke 22 comprises a disk-shaped magnetic-circuit board 22*a* conforming to the center of the lower case 20*b*, and a center pole portion 22*b* which rises from the center of the circuit board. The magnetic-circuit board 22*a* of the yoke 22 is provided with cut-outs 22*c*, 22*d* at portions corresponding to magnet recesses and electrode connecting portions, which will be described later.

A ring-shaped coil 24 is mounted on the outer periphery of the center pole 22*b* of yoke 22. The coil 24 has first and second terminals 24*a*, 24*b*, respectively, let out in mutually opposing directions.

Figure 3:
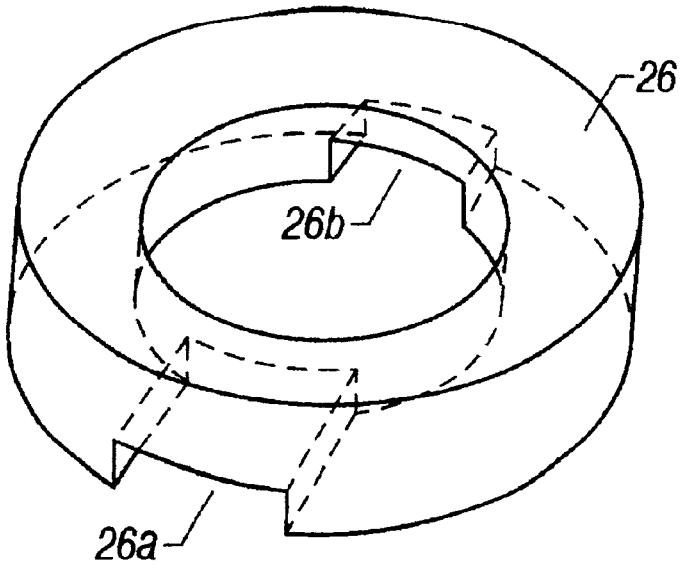
FIG. 3 is a perspective view showing a magnet illustrated in FIG. 1.

A ring-shaped magnet 26 is placed on the magnetic-circuit board 22*a* of yoke 22. As shown also in FIG. 3, the magnet 26 according to this embodiment has an inner circumferential surface, an outer circumferential surface and an underside formed to have identically shaped first and second recesses 26*a*, 26*b* at symmetrical positions. The first and second recesses 26*a*, 26*b* are tunnel-like openings that pass through the magnet 26 from the inner circumferential surface to the outer circumferential surface thereof. In this embodiment, the first and second terminals 24*a*, 24*b* of the coil 24 are connected to electrodes (described later) in the first and second recesses 26*a*, 26*b*, respectively.

A vibration plate 28 has a weight 28*a* attached to it at the center thereof. A ring-shaped supporting frame 30 supports the vibration plate. 28 at its outer periphery and is provided so as surround the magnet 26.

First and second electrodes 32, 34 for surface mounting each consist of a lead frame or the like. Dummy electrodes 36, 38 are also provided. The first and second electrodes 32, 34 and the dummy electrodes 36, 38 are insert-molded at respective ones of the four corners of the lower case 20*b*. One ends of respective ones of the first and second electrodes 32, 34 are formed to have joining portions 32*a*, 34*a*, respectively, led out to the exterior of the lower case 20*b* and joined to electrically conductive patterns or the like of an external circuit board. The other ends of the first and second electrodes 32, 34 are led into the first and second recesses 26*a*, 26*b*, respectively, and form connecting portions 32*b*, 34*b*, respectively.

In the surface-mounted electromagnetic sound generator according to this embodiment constructed as set forth above, the magnet 26 is formed to have the first and second recesses 26*a*, 26*b* at symmetrical positions shown at the top and bottom in FIG. 1. The first terminal 24*a* and second terminal 24*b* of coil 24 are connected by soldering to the connecting portions 32*b*, 34*b*, respectively, of the first and second electrodes 32, 34 within the first and second recesses 26*a*, 26*b*, respectively.

Thus, the magnet 26 is provided symmetrically with the first and second recesses 26*a*, 26*b*. As a result, the magnetic lines of force that act upon the vibration plate 28 opposing the magnet 26 and the magnetic-circuit board 22*a* of yoke 22 are rendered well-balanced and uniform so that abnormal vibration of the vibration plate 28 can be prevented. Further, connecting the first and second terminals 24*a*, 24*b* of coil 24 to the connecting portions 32*b*, 34*b* of the first and second electrodes 32, 34 within the first and second recesses 26*a*,

26*b* of magnet 26 makes it possible to accommodate the connections in the area that receives the magnet 26. This makes it possible to prevent an increase in the size of the device. Since the first and second terminals 24*a*, 24*b* of coil 24 are connected to the connecting portions 32*b*, 34*b* of the first and second electrodes 32, 34 in respective ones of the first and second recesses 26*a*, 26*b* so that only one terminal and one connecting portion are located in each recess, the widths of the first and second recesses 26*a*, 26*b* can be minimized and so can any change in the magnetic force and strength of the magnet 26.

The first and second recesses 26*a*, 26*b* of magnet 26 according to this embodiment are open to the underside of the magnet 26 and to the inner and outer circumferential surfaces thereof in tunnel-like fashion. The first and second recesses 26*a*, 26*b* can be formed easily by cutting work not only when the magnet is molded but also after it is molded.

Figure 4:
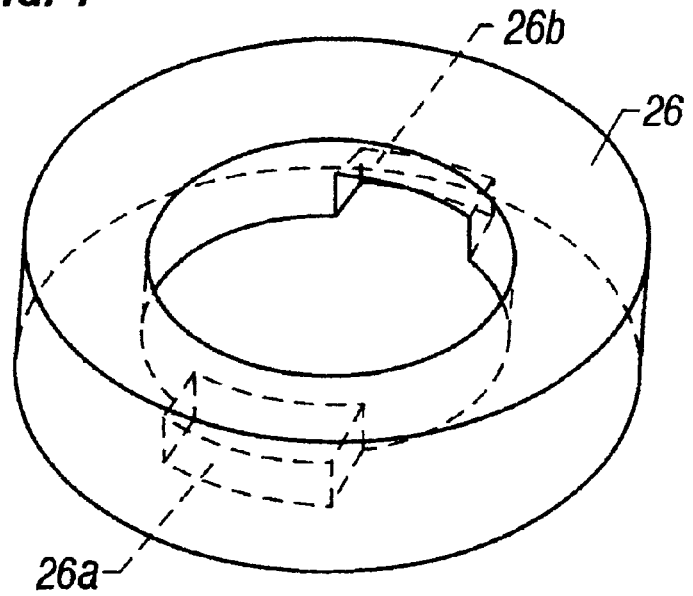
FIG. 4 is a perspective view showing a magnet obtained by partially modifying first and second recesses illustrated in FIG. 3.
Figure 5:
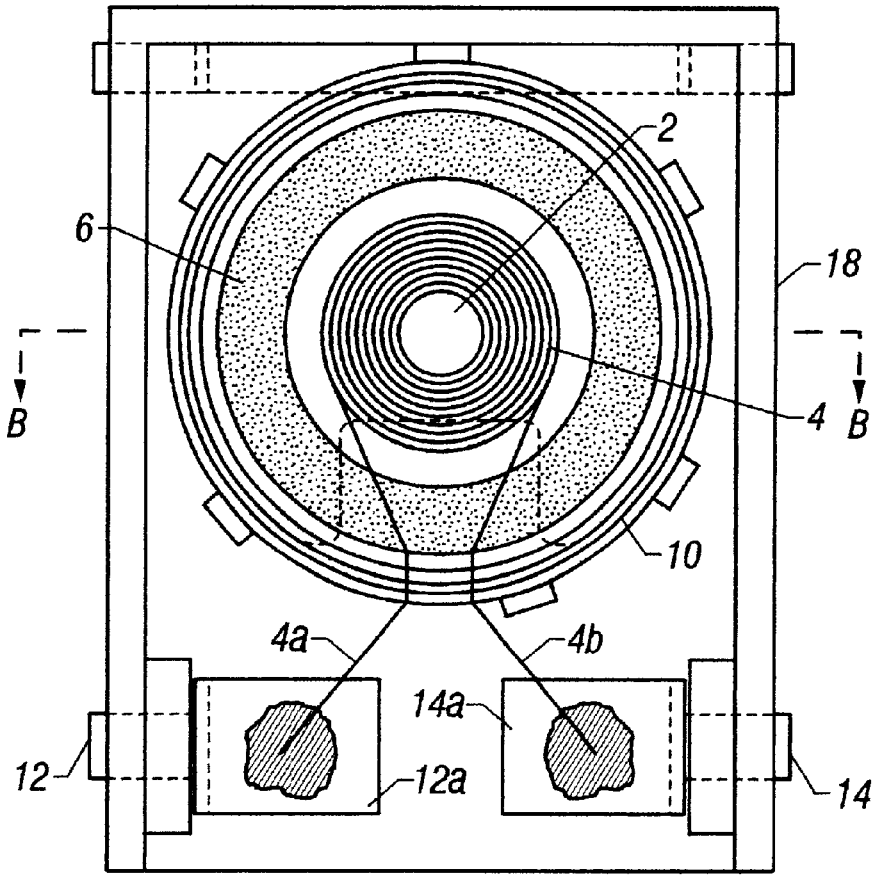
FIG. 5 (Prior Art)
FIG. 5 is a plan view illustrating the structure of a surface-mounted electromagnetic sound generator according to the prior art, this view showing the structure after an upper case and vibration plate have been removed.
Figure 6:
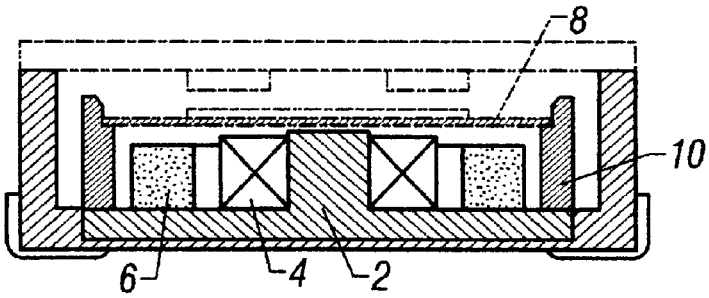
FIG. 6 (Prior Art)
FIG. 6 is a sectional view taken along line B—B of the surface-mounted electromagnetic sound generator shown in FIG. 5.
Figure 7:
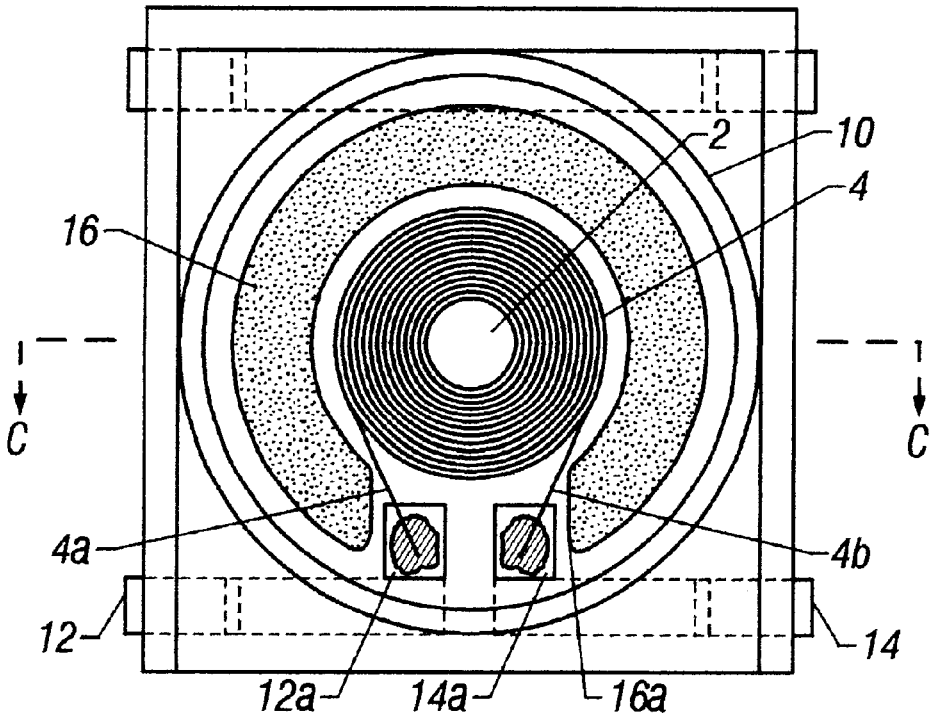
FIG. 7 (Prior Art)
FIG. 7 is a plan view illustrating the structure of a surface-mounted electromagnetic sound generator according to another example of the prior art, this view showing the structure after an upper case and vibration plate have been removed.
Figure 8:
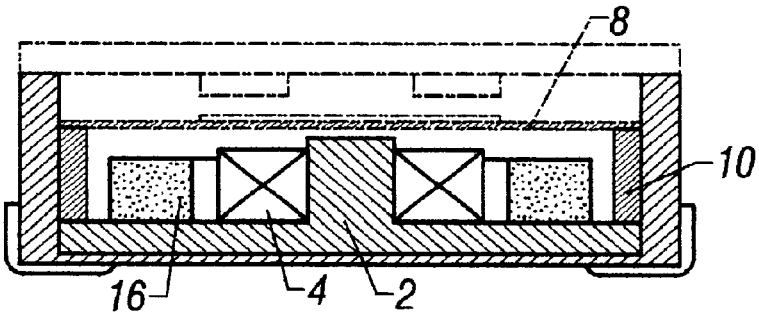
FIG. 8 (Prior Art)
FIG. 8 is a sectional view taken along line C—C of the surface-mounted electromagnetic sound generator shown in FIG. 7.

As illustrated in FIG. 4, it is also permissible to adopt an arrangement in which the first and second recesses 26*a*, 26*b* are formed so as to open only to the underside and inner circumferential surface of the magnet 26. More specifically, the first and second recesses 26*a*, 26*b* are formed so as not to pass completely through the magnet 26 from its inner to its outer circumferential surfaces. Forming the first and second recesses 26*a*, 26*b* to have this shape makes it possible to minimize the size of the open portions so that it is possible to minimize any change in the magnetic force and strength of the magnet 26 brought about by the provision of the first and second recesses 26*a*, 26*b*. Excellent sound quality can be obtained as a result.

Though two recesses are provided in this embodiment, the number thereof can be increased as needed. If the recesses are placed symmetrically for good balance, effects similar to those of the above-described embodiment can be obtained.

In the illustrated embodiment, the first and second terminals 24*a*, 24*b* of coil 24 are connected to the connecting portions 32*b*, 34*b* of the first and second electrodes 32, 34 in respective ones of the recesses 26*a*, 26*b*, with only one terminal and one connecting portion being located in each recess. However, the two terminals 24*a*, 24*b* may be connected to the connecting portions 32*b*, 34*b*, respectively, in one recess only. That is, the connecting portions 32*b*, 34*b* of the first and second electrodes 32, 34 may both be led into one recess, e.g., the first recess 26*a*, with the first and second terminals 24*a*, 24*b* being connected to these connecting portions 32*b*, 34*b*, respectively, in this recess. In this case, however, it is preferred that the connecting portions 32*b*, 24*b* be placed as close together as possible so that the width of the opening of the recess need not be enlarged more than necessary. Further, since it is required that the recesses 26*a*, 26*b* be formed so as to be identical in shape, it is required that the shape and opening width of the other recess in which no connection is carried out be made to match the shape and opening width of the recess in which the connection is made.

Thus, in accordance with the present invention, the terminals of a coil are connected to the connecting portions of surface-mounted electrodes in recesses provided in a magnet at symmetrically located positions. This makes it possible for the connections between the coil terminals and the electrode connecting portions to be accommodated in the area occupied by the magnet. The result is a surface-mounted electromagnetic sound generator that is extremely thin and small in size.

In an embodiment of the present invention, the coil terminals are connected in respective ones of different recesses. The opening width of the recesses can be minimized and so can any change in the magnetic force and strength of the magnet. This makes it possible to improve the performance of the sound generator.

Further, the recesses of the magnet are placed at symmetrical positions and are formed so as to be identical in shape. The characteristics of the magnetic circuit of the magnet can be kept well-balanced, therefore, and it is possible to prevent abnormal vibration of the vibration plate.

As many apparently widely different embodiments of the present invention can be made without departing from the spirit and scope thereof, it is to be understood that the invention is not limited to the specific embodiments thereof except as defined in the appended claims.

What is claimed is:

1. A surface-mounted electromagnetic sound generator comprising:

a case;

a yoke including a magnetic-circuit board accommodated inside said case and having cut-outs;

a coil attached to said yoke and having terminals;

a ring-shaped magnet placed about said coil and having an inner circumferential surface, an outer circumferential surface and an underside provided with a plurality of recesses at symmetrical positions thereof, each recess extending through the magnet in tunnel-like fashion from the inner circumferential surface to the outer circumferential surface;

a vibration plate disposed to oppose said yoke; and a plurality of surface-mounted electrodes each having:

a joining portion led out to the exterior of said case for being joined to an external electrically conductive member; and a connecting portion led into one of the space formed by the recesses of said magnet and the cut-outs of said yoke; and wherein the terminals of said coil extend into the plurality of space formed by the recesses of said magnet and the cut-outs of said yoke and attached to respective ones of the connecting portions of the electrodes.

2. The sound generator according to claim 1, wherein respective ones of the connecting portions of said plurality of electrodes extend into different ones of the plurality of space formed by the recesses and the cut-outs.

3. The sound generator according to claim 1, wherein the connecting portions of said plurality of electrodes extend into one space of the plurality thereof.

4. A surface-mounted electromagnetic sound generator comprising:

a case;

a yoke including a magnetic-circuit board accommodated inside said case and having cut-outs;

a coil attached to said yoke and having terminals;

a ring-shaped magnet placed about said coil and having an inner circumferential surface, an outer circumferential surface and an underside provided with a plurality of recesses at symmetrical positions thereof, each recess extending through the magnet in tunnel-like fashion from the inner circumferential surface without opening to the outer circumferential surface;

a vibration plate disposed to oppose said yoke; and a plurality of surface-mounted electrodes each having:

a joining portion led out to the exterior of said case for being joined to an external electrically conductive member; and a connecting portion led into one of the space formed by the recesses of said magnet and the cut-outs of said yoke; and wherein the terminals of said coil extend into the plurality of space formed by the recesses of said magnet and the cut-outs of said yoke and attached to respective ones of the connecting portions of the electrodes.

5. The sound generator according to claim 4, wherein respective ones of the connective portions of said plurality of electrodes extend into different ones of the plurality of space formed by the recesses and the cut-outs.

6. The sound generator according to claim 4, wherein the connecting portions of said plurality of electrodes are led into one space of the plurality of recesses.

* * * * *